US009360254B2

(12) United States Patent
Johnson

(10) Patent No.: US 9,360,254 B2
(45) Date of Patent: Jun. 7, 2016

(54) EXPANDABLE RAKU KILN

(71) Applicant: Kellogg S. Johnson, Santa Fe, NM (US)

(72) Inventor: Kellogg S. Johnson, Santa Fe, NM (US)

( * ) Notice: Subject to any disclaimer, the term of this patent is extended or adjusted under 35 U.S.C. 154(b) by 434 days.

(21) Appl. No.: 13/842,995

(22) Filed: Mar. 15, 2013

(65) Prior Publication Data

US 2014/0193763 A1 Jul. 10, 2014

Related U.S. Application Data

(60) Provisional application No. 61/750,310, filed on Jan. 8, 2013.

(51) Int. Cl.

| | |
|---|---|
| ***F27B 5/02*** | (2006.01) |
| ***F27B 17/00*** | (2006.01) |
| ***F27D 1/18*** | (2006.01) |

(52) U.S. Cl.

CPC ..... *F27B 17/0041* (2013.01); *F27D 1/1808* (2013.01)

(58) Field of Classification Search

CPC ..... C21D 9/00; F27B 5/00; F27B 5/02
USPC ..... 432/207, 217, 250, 206; 219/385, 390, 219/405, 420

See application file for complete search history.

(56) References Cited

U.S. PATENT DOCUMENTS

| | | | | | |
|---|---|---|---|---|---|
| 3,752,643 | A * | 8/1973 | Robinson | F27B 17/02 | 432/120 |
| 4,139,340 | A * | 2/1979 | Bartel | F27D 17/004 | 432/179 |
| 4,215,265 | A * | 7/1980 | White | F27B 5/04 | 219/390 |
| 4,338,056 | A * | 7/1982 | Abrahamson | F26B 25/001 | 414/152 |
| 4,531,910 | A * | 7/1985 | Geil | F27B 17/0016 | 432/120 |
| 4,660,540 | A * | 4/1987 | Schroder | A21B 3/00 | 126/1 F |
| 5,477,029 | A * | 12/1995 | Skutt | F27B 17/02 | 219/390 |
| 5,848,867 | A * | 12/1998 | Gagnon | B28B 11/245 | 414/155 |
| 6,072,821 | A * | 6/2000 | Axelsson | F27B 5/08 | 373/118 |
| 7,357,632 | B1 * | 4/2008 | Sullivan | F27B 17/0041 | 432/156 |
| 7,458,809 | B2 * | 12/2008 | Hohenshelt | F27B 17/005 | 432/120 |
| 7,861,705 | B2 * | 1/2011 | Hulsey | A47J 37/07 | 126/25 A |
| 2014/0193762 | A1 * | 7/2014 | Grenier | F27B 5/02 | 432/56 |

OTHER PUBLICATIONS

Laguna Clay Company, Cress Kilns, Model comparison chart, pp. 177-179.
Laguna Clay Company, Kiln and Fume Vents, pp. 182-183.
Laguna Clay Company, Laguna Raku Kiln specifications and Model comparison, p. 167-171.
Laguna Clay Company, L & L Kilns and Accessories, pp. 174-176.
Laguna Clay Company, Paragon Electric Kilns, pp. 180-181.
Laguna Clay Company, Skutt Kilns, Model Comparison Chart, pp. 170-173.

* cited by examiner

*Primary Examiner* — Gregory A Wilson
(74) *Attorney, Agent, or Firm* — Stetina Brunda Garred & Brucker; Lowell Anderson

(57) ABSTRACT

A raku kiln has a fire ring with a cylindrical sidewall and bottom made of refractory material with a kiln shelf supported a few inches above the bottom to enclose a space that is superheated by burners. A firing-chamber rests on the fire ring and is lifted by a two aligned pulleys on top of a pole which rotates to move the chamber out of the way. A vertical pole mates with tubes on the chamber for vertical guidance during raising and lowering of the chamber. Flanges on the lower end of the chamber allow adding an extension chamber.

36 Claims, 10 Drawing Sheets

EXPANDABLE RAKU KILN

CROSS-REFERENCE TO RELATED APPLICATIONS

The application claims the benefit under 35 U.S.C. §119e to provisional patent application No. 61/750,310 filed Jan. 8, 2013, the entire contents of which are incorporated herein by reference.

STATEMENT RE: FEDERALLY SPONSORED RESEARCH/DEVELOPMENT

Not applicable

BACKGROUND

Pottery kilns require high temperatures to fire the pottery, with the temperature varying with the type of clay used, any glaze finish applied to the clay and other factors. In order to conserve fuel needed to maintain the high temperatures for firing, most kilns used insulated overs. But for larger pieces of pottery such closed kilns are too small. Further, some types of pottery firing, such as raku, use combustion products and smoke to achieve the desired finish, but the combustion products may coat the oven walls and adversely affect the firing of later pieces of pottery so closed, oven type kilns present problems for large pieces of raku pottery.

For large raku pottery, Laguna Clay makes a firing kiln that has firing chamber that is lifted vertically upward and downward on three vertical posts that are spaced apart around the firing chamber. The standard firing chamber is about 26-32 inches high, requiring the vertical frames to be more than twice that height in order for the chamber to clear the top of the longest pottery that may be placed in the firing chamber. That in turn requires a very tall space within which to place the kiln and limits the height of the firing chamber. Further, the three vertical frames impede access to the kiln both during firing and during loading and unloading of pottery into the kiln. Moreover, when the chamber is lifted it is very hot and having it suspended above the fired pottery makes it hazardous for users to access the fired pottery without touching the hot chamber. Even when the chamber is cool users must take care to avoid bumping their head on it. There is thus a need for an improved kiln that allows the firing of large pieces of pottery but does not require the high clearance of conventional kilns, and that provides better access to the inside of the kiln.

The Laguna kiln has three gas burners which are placed around the perimeter of the kiln floor, with the floor directing the flame from the burners directly up the wall of the firing chamber where they heat the pottery pieces by convection. That provides an updraft heater, but wastes a lot of heat as not only does heated gas rise, but the burners are effectively orientated so as to blow the hot gas outward and upward, where it vents through openings at the top of the kiln. There is thus a need for a more efficient heater for this type of kiln.

BRIEF SUMMARY

A raku kiln has a fire ring with a cylindrical sidewall and bottom made of refractory material with a kiln shelf supported a few inches above the bottom to enclose a space that is superheated by burners. A firing-chamber rests on the fire ring and is lifted by a two aligned pulleys on top of a pole which rotates to move the chamber out of the way. A vertical pole mates with tubes on the chamber for vertical guidance during raising and lowering of the chamber. Flanges on the lower end of the chamber allow adding an extension chamber.

There is thus advantageously provided a firing chamber is provided that is placed above a burner chamber having two venturi burners that are centered under the kiln floor and spaced apart equally from the center of the kiln floor. The burners heat an area under a kiln shelf that is below the kiln floor to create a superheated volume bounded by the kiln floor, the kiln shelf and an encircling fire ring. The superheated volume of gas causes the kiln floor and shelf to heat rapidly and radiate thermal energy to fire the pottery and heat the chamber walls, while the shelf and fire ring deflect the flame to the firing chamber where the chamber walls quickly heat and radiate thermal energy to the pieces being fired. The radiant heating, especially by the kiln floor and shelf, is believed to be more efficient than convection heating at the kiln operating temperatures, thereby providing for more efficient firing of the pottery.

The kiln floor is enclosed in a firing chamber that is configured to be extendable in height. For normal sized pottery pieces the standard chamber can be used which is about two feet high. If larger pieces are to be fired a cylindrical extension can be fastened to the upper portion of the base chamber to double the height to about four feet. Further extensions are possible thereby readily accommodating longer and larger pieces of pottery while allowing adjustment of the chamber size for more efficient operation.

The chamber is removable from the fire ring and is moved along a vertical axis by a post and pulley system that uses a guide post to maintain vertical movement of the chamber while the chamber walls are around the working volume of the chamber. But once the chamber bottom has cleared the working volume the guide post no longer maintains the chamber position and the post rotates about its longitudinal axis to move the chamber off to the side, thus removing the chamber from above the kiln floor to enable easy and fast access to the kiln floor without hindrance by a chamber immediately above the fired pieces. The pulley system may be manually operated for simplicity, or electrically operated for easier and faster positioning of the firing chamber. A tubular sleeve fastened to the outside of the chamber and sliding over a post slightly higher than the chamber provides a simple guide post, and if located by or on the lifting post it also reduces blockage of access to the kiln floor.

There is thus advantageously provided a raku kiln having at least one burner emitting sufficient heat into a primary tubular firing chamber for firing pottery. The kiln includes a primary firing chamber with a thermally insulated sidewall and a closed top. The firing chamber has a bottom opposite the top and a sub-chamber located below the firing chamber during use. The sub-chamber has a refractory bottom and a sidewall that preferably but optionally provides more insulation against heat transfer through the sub-chamber sidewall than through the chamber walls. The sub-chamber may have an upper end substantially blocked by a kiln shelf. The burners are directed toward the kiln shelf. The firing chamber has a bottom engaging the sub-chamber sidewall.

In further variations, the kiln has at least one burner located in a hole in the refractory bottom and emitting combusted gases directly against a bottom of the kiln shelf which is located a few inches from the refractory bottom. Further, the firing chamber has a bottom and a top, with the bottom of the firing chamber resting on a top edge of the fire ring. Additionally, an extension chamber may be used where the extension tube has an upper end wherein the firing chamber has a top configured to engage a lifting device to raise and lower the top, with the firing chamber having a bottom engaging a tubular extension chamber having insulated walls and a bottom configured to engage the sub-chamber sidewall. The kiln may also include a lifting device having a pulley actuated arm engaging the top of the primary firing chamber during use and raise and lower the primary chamber vertically along a longitudinal axis of the kiln. The lifting device may have a pulley actuated arm engaging the top of the primary firing chamber during use to raise and lower the primary chamber vertically along a longitudinal axis of the kiln. The lifting device may include a vertical pole having a longitudinal axis and a laterally extending arm having a first end connected to a sleeve constrained to move along a length of the pole and able to rotate about the longitudinal axis of that pole. The pole may have at least one pulley connected to a pulley base that is configured to rotate about the longitudinal axis of the pole and a cable passing over the at least one pulley. The cable has a first end engaging the arm and a second end connected to one of a counterweight or a winch to raise and lower the lift art, sleeve and primary firing chamber.

In further variations, the kiln may include a first guide tube extending outward from the primary firing chamber, and a guide post aligned with the longitudinal axis of the pole and sized to releasably engage the first guide tube and constrain the guide tube to move along the guide post as long as the guide post is engaged with the guide tube. Further, the primary chamber may have a vertical height H and the guide post and guide tube engage for a length of at least about H. Additionally, a second guide tube may extend outward from the extension firing chamber where the second guide tube is sized and located to releasably engage the guide post and constrain the second guide tube to move along the guide post as long as the guide post is engaged with the second guide tube. The primary chamber may have a height H1 and the extension chamber may have a height of about H2, with the guide post and the second guide tube being configured to be engaged for a length of at least about H1+H2. Alternatively, the guide post and guide tubes may be configured to engage for a length of less than H, and even engage for a few inches, preferably less than about 6 inches.

DETAILED DESCRIPTION

The improved kiln is described with reference to FIGS. 1 and 2 and 8, going from the bottom up, where the relative terms up, down, above, below, upward and down ward are relative the direction of gravity on the kiln assembly as show in FIGS. 1 and 2. Further, as used herein the relative directions inner and outer are with reference to the longitudinal axis of the kiln during heating, with inner referring to a direction toward that longitudinal axis an outer being the opposite direction.

Figure 8:
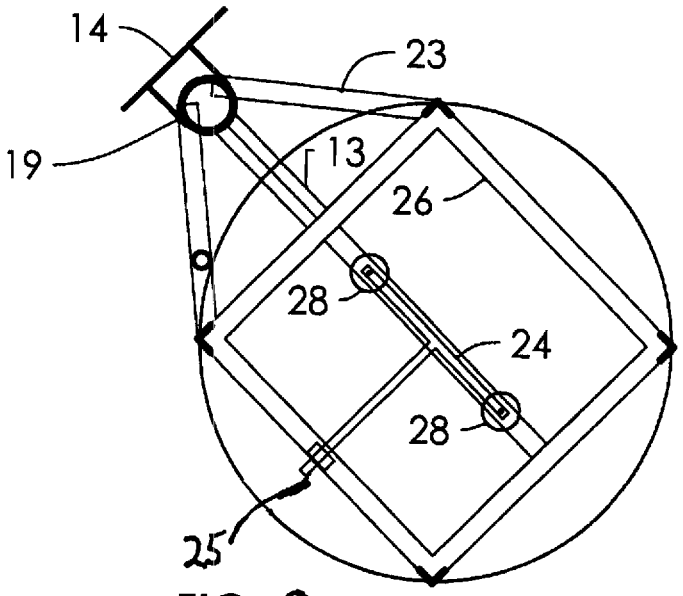
FIG. 8 is a sectional view taken along section 8-8 of FIG. 1.

The kiln has a support frame 26 that rests on the floor and provides a space to orientate venturi burners 28 fed by gas inlet 25 (FIG. 8) that is in fluid communication with manifold 24 (FIG. 8). The frame 26 is shown as an open, box framework with the burners 28 vertically oriented inside the frame 26 and spaced apart an equal distance from a longitudinal axis of the kiln which axis may pass through a center of the frame 26. The burners 28 and manifold 24 may be fastened to the frame 26 in various ways in order to hold the parts in position. Two Venturi burners with about 75,000 BTU output are believed suitable to heat the kiln to temperatures of about 2100° F. to 2300° F., with temperatures from cone 2 to cone 5 being more commonly used.

Figure 13:
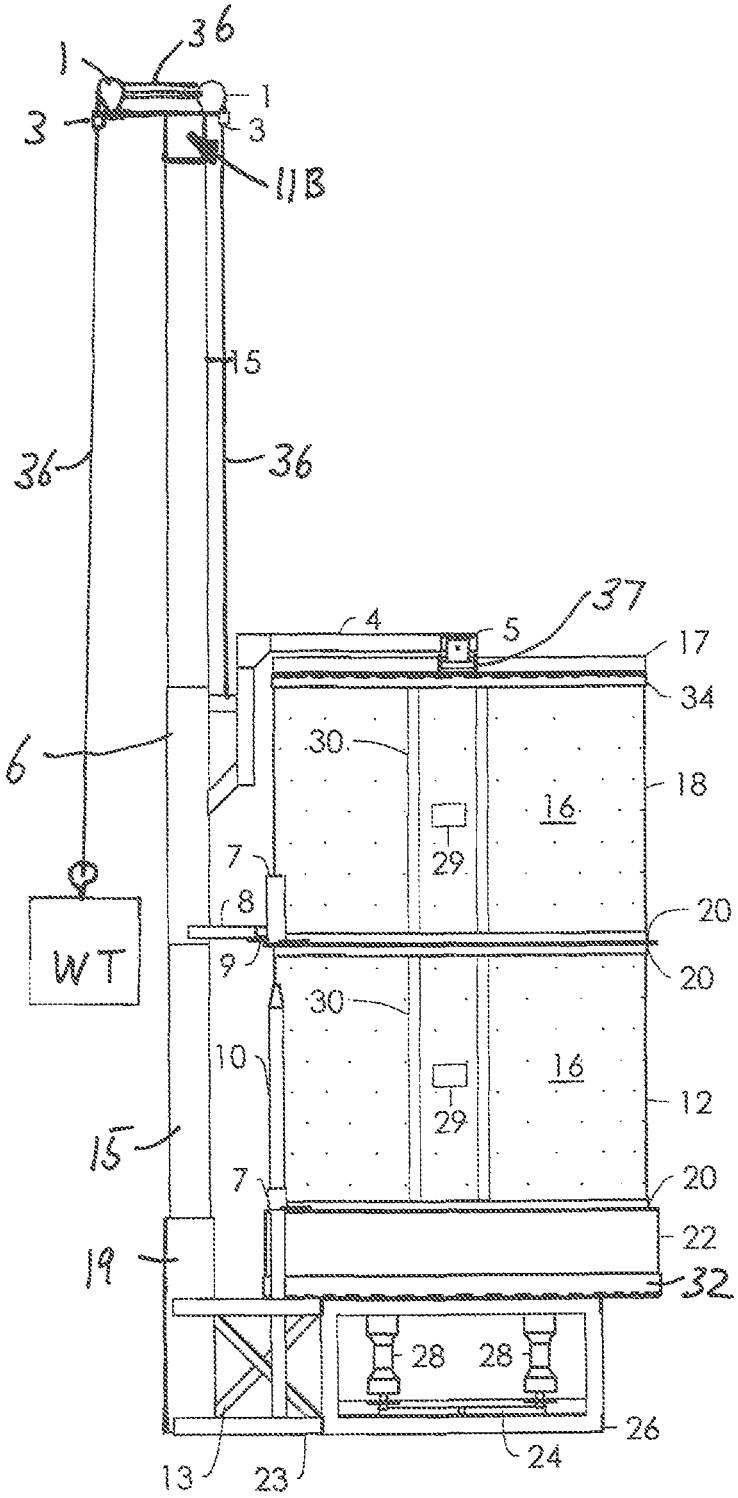
FIG. 13 shows a counterweight system.

Referring to FIGS. 1, 2 and 9-11, on top of the frame rests a layer of fire bricks to form a refractor floor, with frame supports 33 being added as needed to support the bottom of the fire bricks. The refractory floor has openings for the burners 28. On top of the fire bricks is placed a short, cylindrical fire ring 22 having a generally flat bottom. The fire ring is preferably formed of castable refractory material suitable for kiln walls and capable of withstanding high temperatures while providing structural support. The floor of the fire ring 22 has openings for the burners 28. As needed, an annular metal support 32 may encircle the bottom periphery of the fire ring 22. The ring 22 and/or its peripheral support ring 32 may rest upon the refractory floor. The fire ring 22 encircles the exhaust of the burners 28. Inside and at the top of the fire ring 22 is a kiln shelf 31 (FIGS. 11, 13) that may have a circular or polygon periphery that approaches the inner sides of the fire ring 22 but leaves a gap through which heated gases pass.

The kiln shelf 31 may be supported various ways, including the use of legs resting on the floor made of suitable refractory material. But it is believed advantageous to use several fire-bricks of refractory material resting on the refractory floor of the fire ring and extending upward to abut and support a lower surface of the kiln shelf adjacent the outer periphery of the shelf, but slightly inward of that periphery. Depending on the thickness and material of the kiln shelf 31, the number and location of the supports provided by the refractory bricks will vary. The volume within the fire ring 22 sidewalls and bottom and below the kiln shelf 31 becomes superheated during use, with the kiln shelf 31 acting as a radiant heater.

A firing chamber 18 and/or firing chamber extension 12 are placed on top of the firing ring 22. The firing chamber 18 and extension chamber 12 are cylindrical tubes preferably made of expandable metal. One or more, and preferably two layers of insulating material are inside the tubular walls of chamber 18. Two layers of Kao wool, about one inch thick per layer, are believed suitable.

The chambers 12 each have a connecting ring 20 at their lower end and the expansion chamber also has a connecting ring at its upper end. The connecting ring 20 may take the form of a ring that has an L-shaped cross-section with one leg resting on or connected to the top of the fire ring 22 and the other leg extending upward for engagement with a mating edge of the firing chamber 12, 18. The expanded metal cylinder of the chamber 12, 18 may fit inside or outside the annular connector ring 20 and is bolted, welded or otherwise fastened to the connector ring 22. Preferably the flange of the connector ring 20 extends outward and the chambers 12, 18 preferably rest on the outside of the upward-extending leg of the connector ring 22 with the chambers 12, 18 being welded, bolted or otherwise fastened to the connector ring.

Figure 1:
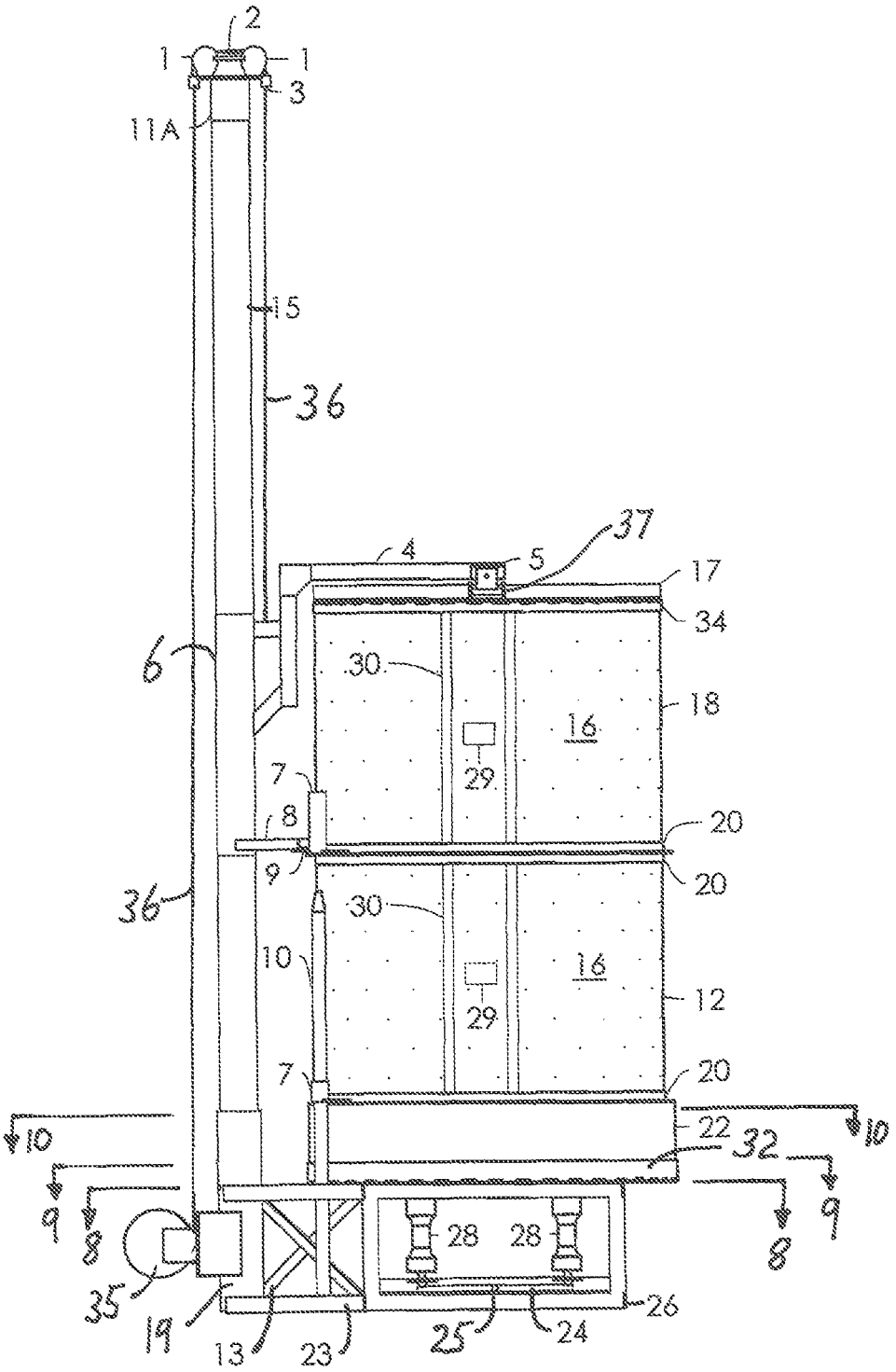
FIG. 1 is a front plan view of a kiln assembly of this invention.
Figure 2:
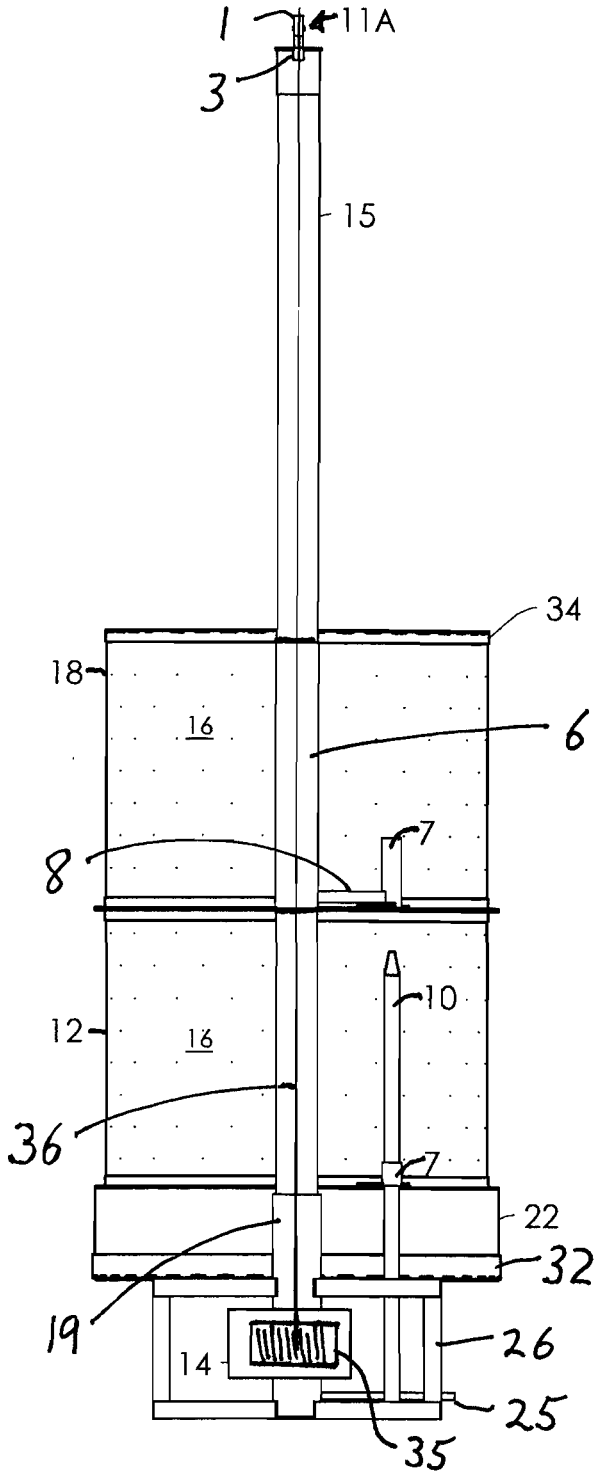
FIG. 2 is a left side plan view of the kiln assembly of FIG. 1.

Referring to FIGS. 1-3 and 12, because the connector ring 20 has an outwardly extending flange, the lower ring on either chamber 12 or 18 may rest on and be fastened to the upper ring of the other chamber 18, 12. In FIG. 1, primary chamber 18 is on top of extension chamber 12. A mounting plate 34 is fastened to the top end of the primary chamber 18, either directly to the sidewall of chamber 18 or to a connector ring 22 if one is placed on the top end of that chamber 18. The mounting plate 34 is connected to a connector bar 17 that advantageously extends across a diameter of the plate 34 and primary chamber 18. The connector bar is configured to releasably engage a lift connector which lifts the chamber 12 and/or 18 upward so they can be swung out of the way.

Referring to FIGS. 1-4, a lift pole 15 is mounted to extend vertically alongside the frame 26 and chambers 12, 18. Preferably the bottom of the lift pole 15 is fastened to the frame 26 to form a movable assembly. The top of the lift pole 15 has a pulley system that may include two pulleys 1 connected by a brace 2. A pulley 1 is on an inner and outer side of the pole 15. A cable extends from an electric winch 14 at the bottom of the pole 15 across both pulleys 1 (FIG. 4) and to a lift bar 4 that engages connector bar 17. Cable guides 3 (FIG. 4) may be provided adjacent the pulleys 1 to guide the cable onto the pulleys. The electric winch 14 winds up and shorten the length of the cable in order to raise the lift bar 4, connector bar 17 and chamber 18 connected chambers 12 and 18. Lengthening the cable length lowers the chambers 12, 18.

In order to keep the chambers from hitting potter resting on the kiln shelf 31 a guide system is provided which may include a guide sleeve 6 encircling the pole 15. The lift bar 4 is connected to the sleeve 6 in order to constrain the lift bar 4 to travel along the length of the pole 15. The sleeve 6 is large enough to slide along the length of the pole, along a longitudinal axis of that pole, but the sleeve is long enough and small enough that the sleeve 6 does not wobble excessively on the pole as such wobble could allow the lift arm 4 to wobble and impart unacceptable motion to the chambers 12, 18. For stability, the lift bar 4 preferably connects to the sleeve 6 at two spaced apart locations, preferably adjacent each opposing end of the sleeve 6.

For additional stability, a stabilizing bar 8 may extend laterally from the sleeve 6, preferably adjacent the lower end of the sleeve 6. The stabilizing guide tube 7 is fastened to the bar 8 and also to the primary chamber 16, preferably fastened to the lower connecting ring on primary chamber 16. Thus, the chamber 16 moves with the sleeve 6 along guide post 10, described below.

In order to keep the lift arm 4 from rotating before the bottom end of the chamber 12 or 18 clears a work piece on the kiln shelf 31, a guide post 10 is provided. The guide post 10 extends parallel to the lift pole 15 and is preferably mounted securely to either the pole 15 or the floor frame 26 or both. The tubular guide sleeve 7 is mounted to the lower end of each chamber 12, 18, preferably connected to the connecting ring 22. The length of guide tube 7 is aligned parallel to the longitudinal axis of the kiln, as are the pole 15 and guide post 10. One or both of the guide tubes 7 slide along a length of the guide post 10 to guide the chambers 12, 18 as they move vertically when lifted by winch 14, lift arm 4 and connector bar 17 which may also be considered as lift brace 17. This allows a stationary guide post 10 to cooperate with a movable guide tube 7 extending from the chambers 12, 18 in order to guide the vertical motion of the chambers as they are raised and lowered. When only the primary chamber 18 is on the fire ring 22, the tube 7 associated with that chamber engages guide post 10. When the extension chamber 12 is connected to the primary chamber 18 then the guide post 7 fastened to the chamber 12 engages the guide post 10, and it is optional whether the tube 7 of chamber 16 slides along the post 10.

Once the bottom of chamber 12, 18 is high enough, the sleeve 6 may rotate about pole 15 so the chambers may be rotated out of the way to allow access to the work pieces in the kiln and to allow faster cooling. The distal end of the guide post 10 may be tapered to make it easier to align the distal end of the guide post with the guide sleeves 7 as the chambers are lowered into the firing position. Advantageously, the height of guide post 10 is selected so that the guide sleeve does not leave the guidance provided by the guide post 10 until the bottom of the chamber 12, 18 is above the working height of the kiln. Thus, the guide post 10 is advantageously as long as the length of the chambers or stack of chambers 12, 18 and ends at the height of those chambers or slightly above that height. But a pulley-cable system is used to lift the chamber 16 or chambers 12, 16 and the cable-pulley system provides some resistance to swinging of the chamber 16 or joined chambers 12, 16 as they are initially lifted and thus a shorter guide post 18 is believed suitable for use. An engagement length of about 18-24 inches of travel of the bottom most sleeve 7 along the guide post 10 is believed suitable.

In use, a single chamber 18 or an extended chamber is assembled with the chambers on the fire ring 22, but preferably located off of the ring 22 and within reach of the lifting arm 4. A connector on the end of the pulley cable engages the lift connector 5 on the brace or connector bar 17 which is connected to the primary chamber 18. The extension chamber 12 may or may not be connected to the primary chamber 18 through the connecting rings 20 interposed between those two chambers and bolted together or otherwise fastened as needed. If the chambers are on the fire ring 22 they are removed so a user can place the pottery work pieces on the kiln shelf 31. As desired, the chambers may rest on the fire ring 22 while the kiln comes to temperature via burners 28 and be removed to load the work pieces onto a preheated shelf 31. The winch 14 and lift arm 4 are used to raise and lower the chambers 12, 18 as desired, and to move them out of the way when not needed by rotating the lift arm 4 and sleeve 6 about the pole 15. When the work pieces are loaded onto the shelf 31 the chambers 18 and/or 12 are placed over the fire ring and guided into position using the guide tubes 7 and the guide post 10 as the winch 14 lowers the chambers. The burners 28 superheat the chamber below the kiln shelf 31 and within the fire ring 22, causing the shelf to re-radiate heat that fires the work pieces and also heats the walls of the chambers 12, 18. The gas deflected off the kiln shelf goes up the side of the chambers where the chamber walls are heated. The chamber walls also radiate to the work pieces to help fire them. Hot gases that do not vent out the sides of the chambers 12, 18 through the expanded mesh of those chamber walls, eventually vents upward through flues 27 in the top of the chamber 18. The flues 27 are advantageously adjustable in size to vary the volume of gases vented out the top. Viewing windows 29 are provided in the walls of chambers 12, 18 to check the firing of the work pieces. Because there are fewer supports for the chambers 12, 18 the viewing windows 29 are more accessible. After firing is completed the winch 14 lifts the chamber or chambers 12, 18 vertically as guided by post 10 and sleeve 7 until a suitable height is reached at which time the chambers 12, 18 may be pivoted out of the way by rotating arm 4 and sleeve 6 about pole 15. Because the hot chambers are moved away from the kiln shelf quickly, the work pieces may be cooled rapidly and cooled with much less risk than if the hot chambers were suspended over the work pieces.

Referring to FIGS. 1-3 and 4-5, if an electric winch 14 is not used, a manual winch (not shown) may be used. If a manual winch is not used, a counterweight may be used in which a counterweight is attached to one end of the cable passing over pulleys 1 in pulley cap 11*b* of FIG. 5. One of the pulleys 1 is offset from the other a greater distance to allow the counterweight to hang fairly straight downward from the overhanging pulley 1. The weight of the counterweight is selected to offset or balance the weight on the other end of the cable so a user can move the counterweight with a small portion of the effort needed to lift the weight of the chambers 12, 18 and the associated weight of the lift arm 4, brace or connector bar 17 and any other components moved with the chambers.

To view the improved kiln in a different light, the same apparatus is now described from a different viewpoint, with more detail to an illustrated embodiment achievable with common structural materials. The kiln has a primary firing chamber 18 constructed with firing chamber connecting ring 20 at the bottom of the chamber with holes to receive bolts for connection to the firing chamber extension 12, a piece of rolled steel plate 34 at the top of the cage which is spanned by firing chamber brace and lift connector receptacle 37 (FIG. 3), both of these rings spanned by expanded metal 16 creating a cage. Because the circumference created by the 96" sheet of expanded metal does not equal a 33" diameter as desired for the preferred cage or chamber 12, 16, expanded steel connectors 30 are installed at both ends of the sheet after being rolled and an extra 6" of expanded metal is added to the primary firing chamber 18 giving the desired 33" diameter. Between the expanded steel connectors on both the primary firing chamber 18 as well as the firing chamber extension 12 are spy holes 29 preferably measuring about 2"×4".

The firing chamber extension 12 is constructed in the same manner as the primary firing chamber 18 with one difference; there are firing chamber connecting rings 20 at both the top and the bottom of the cage. There are holes in the top firing chamber ring 20 of the firing chamber extension 12 that align with holes in the lower chamber ring 20 of primary chamber 18, enabling the two firing chambers to be connected, preferably by bolting the rings together.

Figure 3:
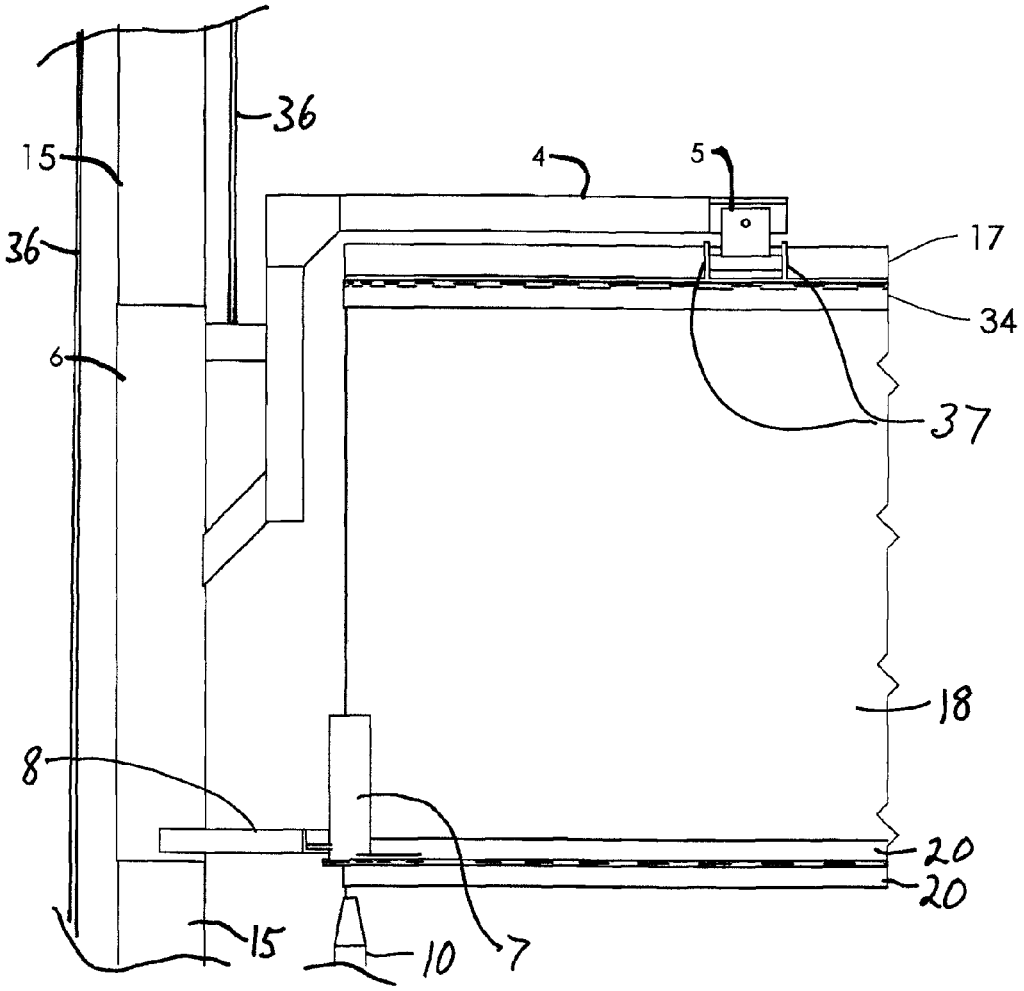
FIG. 3 is an enlarged, partial plan view of the kiln assembly of FIG. 2 showing a firing chamber connected to a lifting apparatus.
Figure 4:
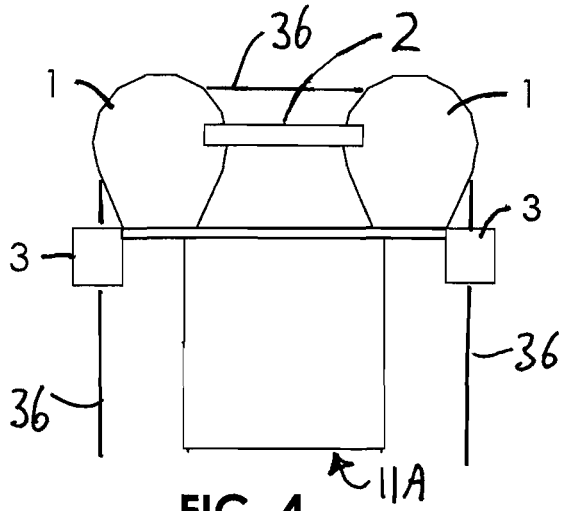
FIG. 4 is an enlarged, partial plan view of the pulley assembly at the top of the lifting apparatus of FIG. 1.
Figure 5:
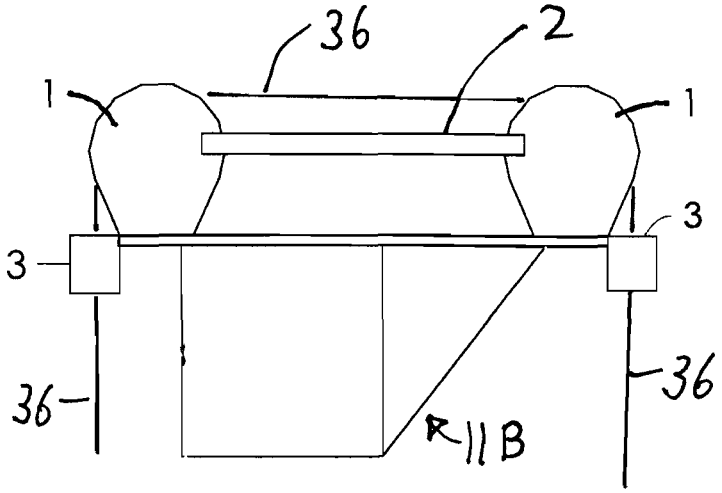
FIG. 5 is an plan view of an alternative embodiment of the pulley assembly of FIG. 4 showing a pulley arrangement for a counterweight assembly.

The lift pole 15 has a pulley cap on the top as shown in FIGS. 4 and 5. The lift mechanism as shown in FIG. 3 slides up and down the lift pole 15 and can rotate about that pole when not restrained from doing so. The guide system shown in FIG. 6 restrains that rotation during a portion of the vertical motion of the chamber and directs the firing chamber to its resting position.

The steel frame floor is shown in FIG. 8 and is preferably constructed of 1½"×1½"×⅜" steel angle which creates a cage dimensions 34"×34"×12". In this frame 26 is mounted the gas manifold 24 supplying the two venturi burners 28 with gas. This steel frame floor supports the steel angle ring 32 containing the castable floor and firing ring 22. The firing ring 22 preferably is cast onto the refractory floor or cast separately and placed on the refractory floor with annular ring 32 intervening between the refractory floor and the ring 22.

FIG. 3 shows a portion of the lift mechanism. The lift arm 4 is connected to a lift sleeve 6 that rides up and down the lift pole 15. This allows for both firing chambers 18 and 12 to be swung in either direction about the axis of pole and thus to be moved out of the way when the desired height is reached. The lift arm 4 attaches to the primary firing chamber 18 via the lift connector 5, which is connected to the firing chamber brace or connector bar 17, preferably using bolts for ease of assembly and mobility.

FIG. 4 shows the pulley cap 11*a* that is preferred for electric winches. This pulley cap 11*a* is supplied with an electric winch 14 that may be at the bottom of pole, or elsewhere, preferably along the pole 15. The pulley cap 11*a* is placed at the top of the lift pole 15 and pivots or swings in either direction as the firing chamber is swung or rotated in either direction. The pulley cap 11 may be independently rotatable about the axis of pole 15 and this may be achieved by placing the pulley cap on a sleeve that is concentric with the longitudinal axis of pole 15, or by providing a bearing assembly between the end of the pole 15 and the pulley cap 11*a* to facilitate rotation of the pulley cap. The pulley cap 11*a* may have two 650 lb pulleys 1, braced by two pulley braces 2, spanning the two pulleys 1. The pulleys 1 are mounted to the pulley cap 11*a* that may take the form of a 3⅝"×¼" steel pipe receptacle connected to a 6"×4"×¼" steel plate orientated horizontally to rest on top of the pole 15, preferably with the sleeve inside or outside the pole but concentric with the pole. The pulley cap 11*a* is not attached to the lift pole 15 but is allowed to swivel on it about the longitudinal axis of the pole 15. Connected to both of the pulley cap steel plates just below the pulleys 1 are cable guides 3, preferably made of 1"×⅜" steel pipe.

FIG. 5 shows the pulley cap 11*b* for use with a manual winch or a counter weight. Pulley cap 11*b* is provided for kilns using a counter weight system. This pulley cap 11*b* has a 12" long mounting plate verses the 6" long mounting plate of pulley cap 11*a*. The extra length allows for the diameter of the concrete counterweight. As seen in FIG. 14, the counterweight is suspended from one end of the cable and the lift arm 4 from the other end, with the counterweight being about the same weight as the chamber or chambers 12, 18 and suspended weight on the end of the cable opposite the counterweight. The counterweight may be adjusted as the suspended weight of the chambers 12, 18 and associated equipment varies.

Figure 6:
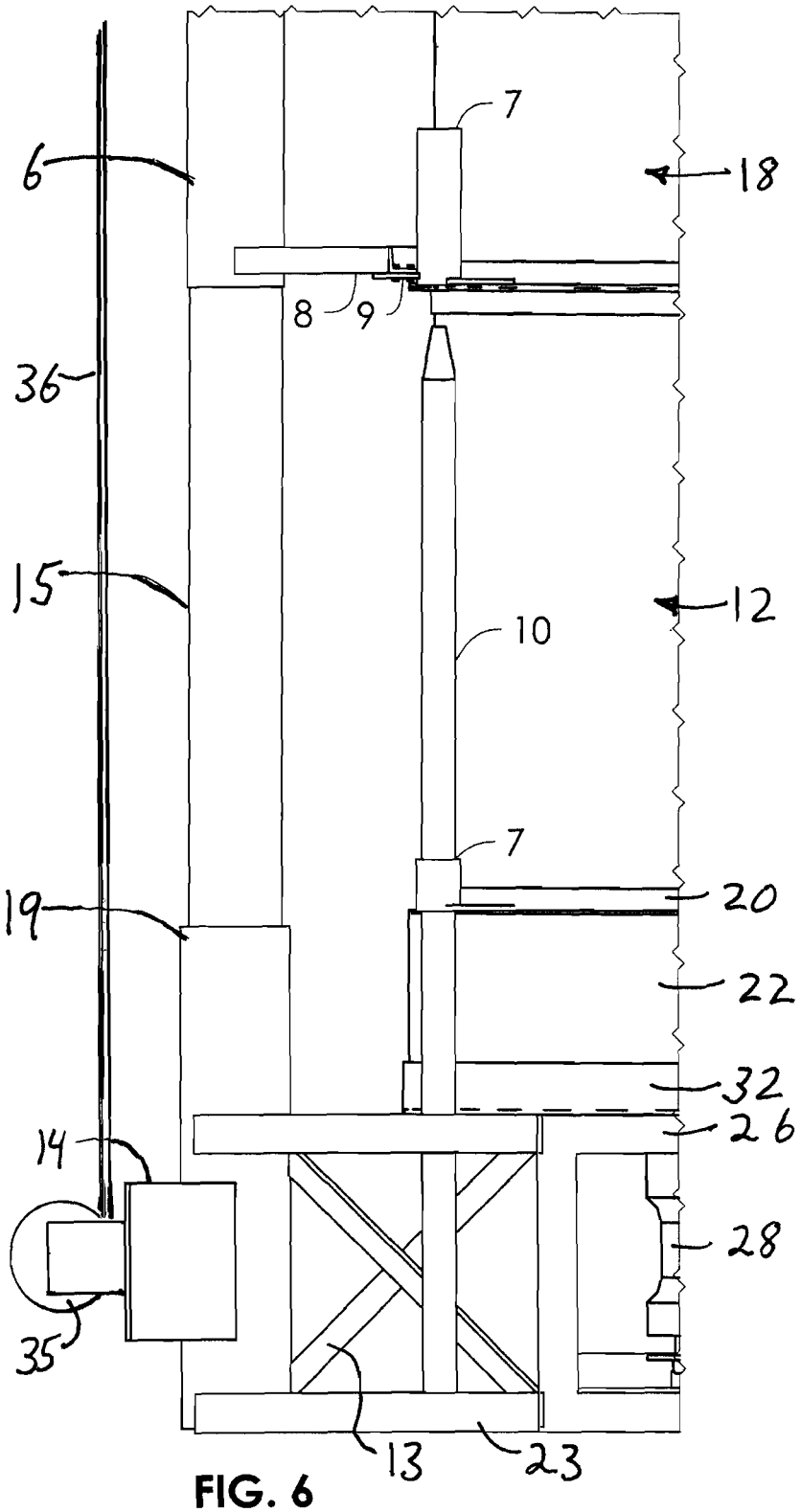
FIG. 6 is an enlarged, partial plan view of the kiln assembly of FIG. 2 showing a guide post.

FIG. 6 shows the guide system, which may include a guide rod 10. A suitable guide rod is believed to be a 40"×1¼" steel tube or rod that extends vertically from the floor frame at ground level. Attached to the primary firing chamber 18 and firing chamber extension 12 are guide sleeves 7. As the firing chambers 12, 18 descend, the guide sleeve 7 is received by the guide rod 10, which then guides the firing chamber to the castable ring 22 at the firing floor. The guide system is advantageously only in place to direct the firing chamber 12, 18 during the last few inches of its descent and should create as little friction or drag as possible. The length of the guide rod and sleeves will vary, as will the length of the guided motion of the chambers 12, 18 provided by the guide system.

Figure 10:
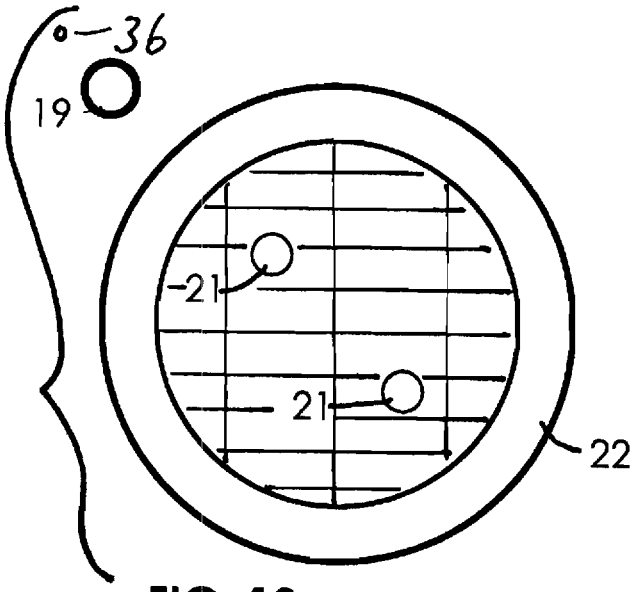
FIG. 10 is a top plan view showing the arrangement of burners and an encircling fire ring.

The guide system may have a stabilizing arm 8 (FIG. 1) that attaches to the lift sleeve 6 and bolts to the guide sleeve connecting plate 9 (FIG. 6) and creates stability for the guide system. Refer to FIG. 10 for an aerial view of this.

Figure 7:
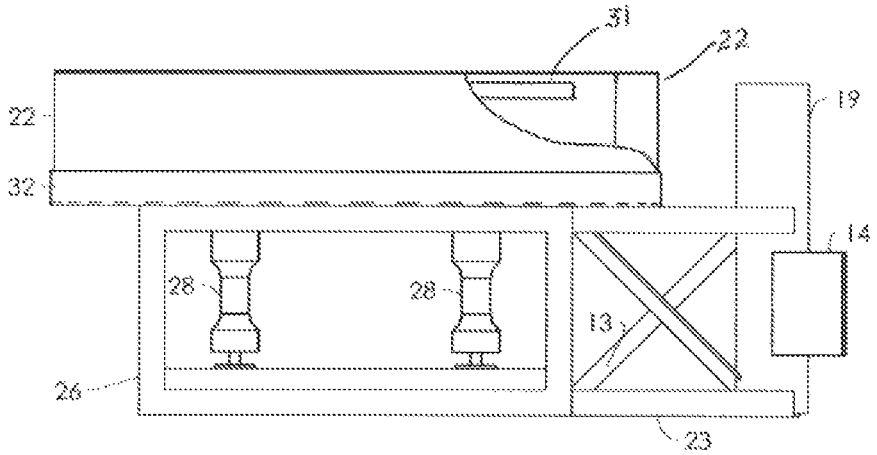
FIG. 7 is an enlarged, partial plan view of a back side of a firing chamber from the opposing direction of FIG. 1.

FIG. 7 shows the firing floor frame 26. The firing floor frame may be built with 1½"×1½"×⅜" steel angle. The two venturi burners 28 are spaced 14" on center in the middle of the kiln floor for use with the chambers 12, 18 of the described dimensions. The spacing may vary with the chamber dimensions.

The lift pole receptacle 19 is mounted to the floor frame 26 by four connecting braces 23 and two cross braces 13. These cross braces are essential for rigid support. Attached to the lift pole receptacle is the electric winch mount 14.

FIG. 8 shows the floor frame 26 with the burner manifold 24 and burners 28. An aerial view of steel floor frame 26 at ground level is also seen, along with the connecting braces for the lift pole receptacle 23, placement for the cross braces 13, the lift pole receptacle 19, and the electric winch mount 14. Gas manifold 24 is shown as holding two venturi burners 28 and the gas coupler 25 for the gas source. The number and precise location of the burners 28 may vary, but they advantageously are directed upward toward the bottom of kiln shelf 31.

Figure 9:
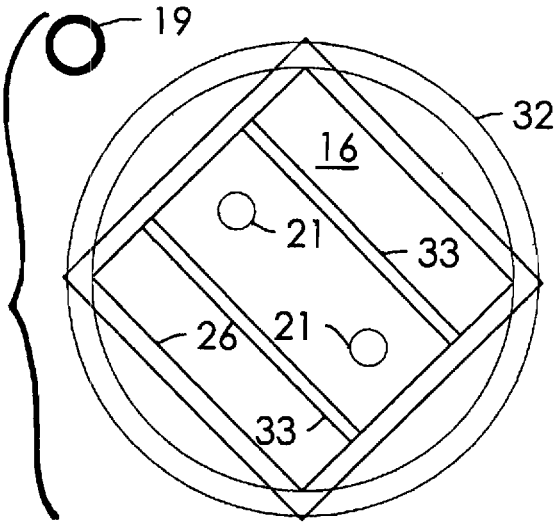
FIG. 9 is a sectional view taken along section 8-8 of FIG. 1.

FIG. 9 shows the floor frame 26 with burner ports 21 and the castable ring 22. An aerial view of the steel floor frame 26 at the level of the steel angle ring for castable 32 is also shown. Two floor braces 33 span floor frame 26 and flank the burner ports 21. Expanded steel 16 may be cut to the diameter of the steel angle ring 32 in order to create a support system for the castable refractory ring 22.

FIG. 10 shows the castable firing floor and ring 22. An aerial view of castable refractory floor and ring 22 is shown. A ring 22 of about 34" in diameter, with a ring height of about 6" and a floor thickness of about 2" or 2½" is believed suitable.

Figure 11:
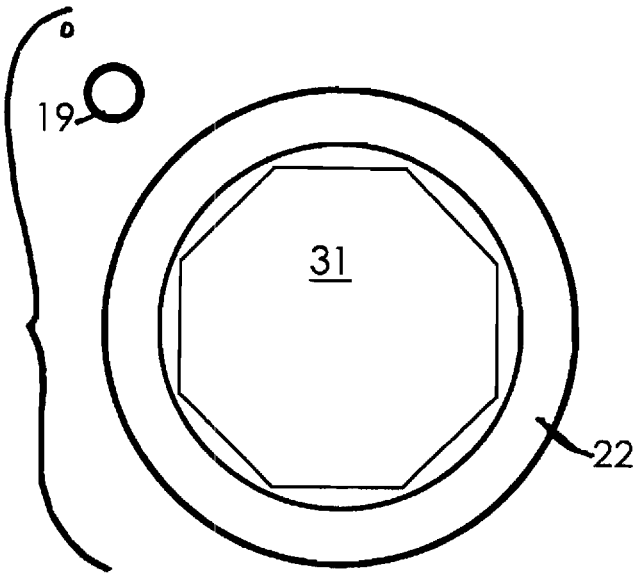
FIG. 11 is a top plan view showing the arrangement of a kiln shelf and an encircling fire ring.

FIG. 11 shows the kiln shelf 31. An aerial view of the circular floor of the castable refractory floor and ring 22 is shown. The fire ring (and its floor) have a kiln shelf 31 about 2-5 inches above the floor of the fire ring, preferably about 2½" above the castable floor and inside the perimeter of the castable ring 22, creating a chamber which becomes superheated by the flames from the two venturi burners 22 and which radiates to and heats the firing chamber 18 or the extended firing chamber 12 and 18.

Figure 12:
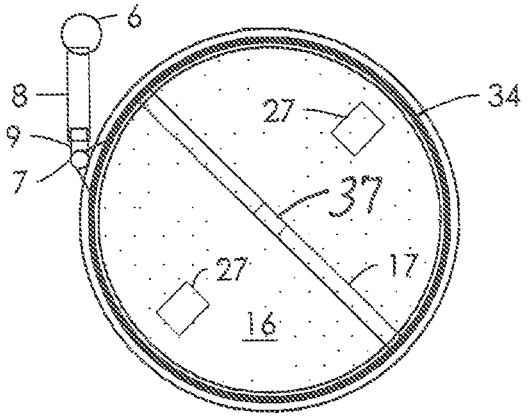
FIG. 12 is a top plan view of a lift connector at the top of the fire chamber.

FIG. 12 shows an aerial view of primary firing chamber 34. The primary firing chamber 18 may be made of rolled steel plate 34 and at the top perimeter the chamber is spanned by the firing chamber brace or connector bar 17 and lift connector receptacle 37. The diameter of the rolled steel plate 34 is spanned by expanded steel 16 with two openings for flues 27 measuring 4'×3".

The lifting mechanism using one lifting pole 15 and one lift arm 4 allows for the firing chamber 18, or 12 and 18, to be swung out of the way when the desired height is acquired. The single pole allows greater access, increases portability, reduces cost and provides simpler operation.

The use of a single guide pole 10 an guide sleeve 7 on the chamber 12 or 18 directs the firing chamber 18, or 12 and 18, to its resting place and also disconnects automatically on the ascent of the firing chambers past the end of the guide pole, thereby allowing the firing chamber to be swung out of the way when the desired height is achieved, while providing guided motion during the initial raising of the chamber and during the final seating or lowering of the chamber.

Rather than locating burners around the perimeter of the kiln floor which directs the burners flame directly up the wall of the firing chamber as in the prior art, the described kiln has two venturi burners 28 centered under the kiln floor and spaced about 14" on center to directly heat the area under the kiln shelf 31 which is located within the space created by and enclosed by the castable firing ring 22 and the kiln shelf. As the space between the kiln shelf 31 and floor of the fire ring 22 is superheated by the venturi burners the heat radiates and the flame deflects to the firing chamber.

Further, the prior art does not have the fire ring 22 and thus the firing chamber did not provide the extra insulation and strength of the four inch thick fire ring 22 described herein. The fire ring 22 and its refractory floor provide a well-insulated container, with the kiln shelf 31 at the top of that insulate container so the chamber and burners 28 direct the heat toward the shelf 31, and then outward. The result is a superheated chamber with the fire ring 22, refractory floor and shelf 31 becoming unusually hot and radiating much more heat than in the prior art. The prior art thus also lacked the flow blockage provided by the kiln shelf 31 which effectively encloses the upper end of the superheated chamber. The kiln shelf 31 blocks a substantial portion of the cross-sectional area of the fire ring at the location of the shelf. As used herein, blockage of a substantial portion blocks about 70% or more of the cross-sectional area of the fire ring 22 at the location of the shelf, and preferably blocks about 85% or more of the cross-sectional area at the location of the shelf 31.

The superheated sub-chamber is about as large in diameter as the primary chamber but is relatively short in height measured along the longitudinal axis of the kiln. A sub-chamber height of a few inches is preferred, with the bottom of the shelf 31 being about 1-5 inches, and preferably about 2-3 inches from the refractor bottom of the fire ring 22. The fire ring 22 is relatively thick, about four inches thick and provides a sidewall with a top on which the firing chamber 18 or 12 and 18 rest during use, the sidewall of the fire ring having sufficient strength to support that weight. The fire ring 22 provides more thermal insulation than the walls of chambers 12, 18, preferably from 50% to 100% additional resistance to heat transfer or additional insulation than do the walls of chambers 12, 18.

The prior art firing chambers were also smaller in diameter than the preferred chambers 12, 18, which are about 24" high×34" diameter for the primary chamber 18, with the extension 12 providing an additional chamber about 24" high×34" diameter and when bolted to the primary firing chamber 18 extends the firing chamber capacity to about 48" high. The prior art chambers were shorter than a single chamber 12, 18 and the kiln shelf extended into the chamber further reducing the working volume and working height of the chamber.

The use of a pulley cap 11*a*, 11*b* allows rapid and easy lifting of the chambers 12, 18. Depending on whether the lifting mechanism is powered by an electric winch (FIG. 4-11A) or counter weighted (FIGS. 5 and 13), the arrangement may vary. But the pulleys are simple structures providing mechanical advantage, ease of use, ease of maintenance, and high reliability. The use of the same basic system on a longer mounting plate helps locate one pulley 1 offset from the centerline of pole 15 in order to better accommodate the use of a simple counterweight made of metal, concrete, or other available material.

As used herein, the part numbers are as provided in the following legend:

1) 650 lb pulley
2) 2 Pulley Braces, one on either side of pulleys
3) Cable Guide
4) Lift Arm
5) Lift Connector
6) Lift Sleeve 23"×3"×¼" steel pipe
7) Guide Sleeve for Primary Firing Chamber and Firing Extension
8) Stabilizing Arm for Guide System 6"×1"×2" steel channel
9) Guide Sleeve connecting plate
10) Guide Rod 40"×1¼"×⅛" with tapered tip to ½"
11A) Pulley Cap 3⅝"×¼"steel pipe and 6"×4"×3/16" steel plate 11B) Pulley Cap 3⅝"×¼" steel pipe and 12"×¼" steel plate
12) Firing Chamber Extension 24" high×33" diameter
13) Cross Braces connecting to Base Frame and Lift Pole Receptacle 1"×1"×3/16"
14) Electric Winch Mount
15) Lift Pole 10'×3"×¼" steel
16) Expanded Steel Cage
17) Firing Chamber Brace 33"×1½"×1½"×3/16" steel
18) Primary Firing Chamber 24"×33" diameter
19) Lift Pole Receptacle 3⅝"×¼" steel pipe
20) Firing Chamber Connecting Ring 1"×1"×3/16" rolled angle 33" ID×34"OD
21) Burner Port with 3" diameter
22) Castable Ring 34"×4"×6" castable refractory floor and ring
23) Connecting Braces for Lift Pole Receptacle 1½"×1½"×3/16" steel angle
24) Gas Manifold
25) Gas coupler for manifold
26) Steel Floor Frame 1½"×1½"×3/16" steel angle
27) Flu 4"×3"
28) Venturi Burners
29) Spy Holes 2½"×4"
30) Expanded Steel Connectors 1"×⅛" steel plate
31) Kiln Shelf 20"×20"×1" all four corners have been cut off to fit inside castable ring
32) Steel Angle ring 2"×2"×⅛" for castable
33) 1"×1"×⅛" steel angle floor braces
34) Rolled Steel Plate 1"×⅛"
35) Electric Winch
36) Winch Cable
37) Lift Connector Receptacle Although these inventions have been disclosed in the context of certain preferred embodiments and examples, it will be understood by those skilled in the art that the present inventions extend beyond the specifically disclosed embodiments to other alternative embodiments and/or uses of the inventions and obvious, modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A kiln having at least one burner emitting sufficient heat into a primary tubular firing chamber for firing pottery; comprising:

a primary firing chamber with a thermally insulated sidewall and a closed top, the firing chamber having a bottom opposite the top, and at least one vent in the primary firing chamber top, a sub-chamber located below the firing chamber during use, the sub-chamber having a refractory bottom and having a refractory sidewall enclosing sides of a kiln shelf, the sub-chamber having an upper end substantially blocked by the kiln shelf, the at least one of the burners being located to fire into the sub-chamber and directed toward the kiln shelf, the firing chamber having a bottom engaging the sub-chamber sidewall.

2. The kiln of claim 1, wherein the at least one burner is located in a hole in the refractory bottom and emits combusted gases directly against a bottom of the kiln shelf which is located a few inches from the refractory bottom.

3. The kiln of claim 2, wherein the firing chamber has a bottom and a top, with the bottom of the firing chamber resting on a top edge of the sub-chamber sidewall.

4. The kiln of claim 1, wherein the firing chamber has a top configured to engage a lifting device to raise and lower the top vertically.

5. The kiln of claim 4, the firing chamber has a bottom engaging a tubular extension chamber having insulated walls and a bottom configured to engage the sub-chamber sidewall.

6. The kiln of claim 5, further comprising a lifting device having a pulley actuated arm engaging the top of the primary firing chamber during use and raise and lower the primary chamber vertically along a longitudinal axis of the kiln.

7. The kiln of claim 6, wherein the lifting device comprises a vertical pole having a longitudinal axis and a laterally extending arm having a first end connected to a sleeve constrained to move along a length of the pole and able to rotate about the longitudinal axis of that pole, and further comprising at least one pulley connected to a pulley base that is configured to rotate about the longitudinal axis of the pole;

a cable passing over the at least one pulley, the cable having a first end engaging the arm and a second end connected to one of a counterweight or a winch to raise and lower the lift art, sleeve and primary firing chamber.

8. The kiln of claim 7, further comprising a first guide tube extending outward from the primary firing chamber, and further comprising:

a guide post aligned with the longitudinal axis of the pole and sized to releasably engage the first guide tube and constrain the guide tube to move along the guide post as long as the guide post is engaged with the first guide tube.

9. The kiln of claim 8, wherein the primary chamber has a vertical height H and the guide post and guide tube engage for a length of at least about H.

10. The kiln of claim 9, further comprising a second guide tube extending outward from the extension firing chamber, the second guide tube being sized and located to releasably engage the guide post and constrain the second guide tube to move along the guide post as long as the guide post is engaged with the second guide tube.

11. The kiln of claim 10, wherein the primary chamber has a vertical height H and the guide post and guide tube are configured to engage for a length of less than H.

12. The kiln of claim 7, wherein the at least one pulley comprises two pulleys each rotating about separate longitudinal axes which axes are parallel and spaced apart, both pulleys being mounted to the pulley base.

13. The kiln of claim 1, further comprising a lifting device having a pulley actuated arm engaging the top of the primary firing chamber during use to and raise and lower the primary chamber vertically along a longitudinal axis of the kiln.

14. The kiln of claim 13, wherein the lifting device comprises a vertical pole having a longitudinal axis and a laterally extending arm having a first end connected to a sleeve constrained to move along a length of the pole and able to rotate about the longitudinal axis of that pole, and further comprising:

at least one pulley connected to a pulley base that is configured to rotate about the longitudinal axis of the pole;

a cable passing over the at least one pulley, the cable having a first end engaging the arm and a second end connected to one of a counterweight or a winch to raise and lower the lift art, sleeve and primary firing chamber.

15. The kiln of claim 14, further comprising a first guide tube extending outward from the primary firing chamber, and further comprising:

a guide post aligned with the longitudinal axis of the pole and sized to releasably engage the first guide tube and constrain the guide tube to move along the guide post as long as the guide post is engaged with the guide tube.

16. The kiln of claim 15, wherein the primary chamber has a vertical height H and the guide post and guide tube engage for a length of at least about H.

17. The kiln of claim 16, wherein the primary chamber has a height H1 and the extension chamber has a height of about H2, and the guide post has and the second guide tube are configured to be engaged for a length of at least about H1+H2.

18. The kiln of claim 17, wherein the primary chamber has a vertical height H and the guide post and guide tube are configured to engage for a length of less than H.

19. The kiln of claim 14, wherein the at least one pulley comprises two pulleys each rotating about separate longitudinal axes which axes are parallel and spaced apart, both pulleys being mounted to the pulley base.

20. The kiln of claim 19, wherein the two pulleys are connected by a brace and wherein the pulley base has a tubular portion sized to fit over a distal end of the pole and rotate about a longitudinal axis of that pole, the tubular portion having a closed end of sufficient strength to rest on the distal end of the pole during use.

21. The kiln of claim 1, further comprising:

a lifting device having a pulley actuated arm engaging the top of the primary firing chamber during use to and raise and lower the primary chamber vertically along a longitudinal axis of the kiln, the pulley actuating the arm vertically being mounted to rotate laterally in a plane orthogonal to the longitudinal axis of the kiln to allow rotation of the primary firing chamber in said plane.

22. The kiln of claim 21, further comprising a first guide tube extending outward from the primary firing chamber, and a guide post aligned with the longitudinal axis of the kiln during use and sized to releasably engage the first guide tube and constrain the first guide tube to move along the guide post and restrain rotation of the kiln in said plane, the guide post having a length selected to allow the first guide tube to move off the guide post and all rotation of the kiln in said plane.

23. The kiln of claim 1, wherein the resistance to heat transfer through the sidewall of the primary firing chamber is greater than the resistance to heat transfer through the sub-chamber sidewall.

24. A kiln having at least one burner emitting sufficient heat into a primary tubular firing chamber for firing pottery; comprising:

a primary firing chamber with a thermally insulated sidewall and a closed top having a vent therein, the firing chamber having a bottom opposite the top, a sub-chamber located below the firing chamber during use, the sub-chamber having a refractory bottom and having refractory sidewall, the sub-chamber having an upper end substantially blocked by a kiln shelf the sides of which are enclosed by the sub-chamber sidewall, the burners being directed toward the kiln shelf, the firing chamber having a bottom supported by the sub-chamber sidewall;

the firing chamber having a bottom engaging a tubular extension chamber having insulated walls and a bottom configured to engage the sub-chamber sidewall; and a lifting device having a pulley actuated arm engaging the top of the primary firing chamber during use to and raise and lower the primary chamber vertically along a longitudinal axis of the kiln.

25. The kiln of claim 24, wherein the pulley actuating the arm vertically is mounted to rotate laterally in a plane orthogonal to the longitudinal axis of the kiln to allow rotation of the primary firing chamber in said plane; and further comprising a first guide tube extending outward from the primary firing chamber, and a guide post aligned with the longitudinal axis of the kiln during use and sized to releasably engage the first guide tube and constrain the first guide tube to move along the guide post and restrain rotation of the kiln in said plane, the guide post having a length selected to allow the first guide tube to move off the guide post and all rotation of the kiln in said plane.

26. A kiln having at least one burner emitting sufficient heat into a primary tubular firing chamber for firing pottery; comprising:

a primary firing chamber with a thermally insulated sidewall and a closed top with a vent therein, the firing chamber having a bottom opposite the top, a sub-chamber located below the firing chamber during use, the sub-chamber having a refractory bottom and having a sidewall that provides some insulation to heat transfer through the sub-chamber sidewall, the sub-chamber having an upper end substantially blocked by a kiln shelf, the burners being directed toward the kiln shelf bottom, the firing chamber having a bottom engaging the sub-chamber sidewall;

the firing chamber having a bottom engaging a tubular extension chamber having insulated walls and a bottom configured to engage the sub-chamber sidewall; and a lifting device having a pulley actuated arm engaging the top of the primary firing chamber during use to and raise and lower the primary chamber vertically along a longitudinal axis of the kiln, the pulley actuating the arm being mounted to rotate laterally in a plane orthogonal to the longitudinal axis of the kiln and to allow rotation of the primary firing chamber in said plane, a first guide tube located outward from the primary firing chamber and parallel to the longitudinal axis, and a guide post aligned with the longitudinal axis of the kiln during use and sized to releasably engage the first guide tube and constrain the first guide tube to move along the guide post and restrain rotation of the kiln in said plane, the guide post having a length selected to allow the first guide tube to move off the guide post.

27. The kiln of claim 26, wherein the sub-chamber sidewall is a castable refractory material.

28. The kiln of claim 26, further comprising a secondary firing chamber having thermally insulated sidewalls surrounding the longitudinal axis, the secondary firing chamber having an open top and open bottom and interposed between the primary firing chamber and the sub-chamber sidewall during use and supported by the sub-chamber sidewall during use.

29. A kiln for firing pottery, the kiln having at least one burner emitting sufficient heat into a primary tubular firing chamber having a longitudinal axis to fire pottery, comprising:

a primary firing chamber having thermally insulated sidewalls surrounding the longitudinal axis and a closed top having a vent therein, the firing chamber having an open bottom opposite the top, and at least one vent in the primary firing chamber;

a sub-chamber located below the firing chamber during use, the sub-chamber having a bottom of refractory material and sidewalls of a cast refractory material suitable for use in a kiln, the sub-chamber having an upper end substantially blocked by a kiln shelf located below a height of the sub-chamber sidewalls and having a bottom of the shelf a few inches away from the sub-chamber bottom, the at least one of the burners being located to fire into the sub-chamber and heat the kiln shelf, the firing chamber supported by the sub-chamber sidewall during use.

30. The kiln of claim 29, wherein only the sub-chamber has a burner.

31. The kiln of claim 29, further comprising a secondary firing chamber having thermally insulated sidewalls surrounding the longitudinal axis with an open top and open bottom and interposed between the primary firing chamber and the sub-chamber sidewall during use and supported by the sub-chamber sidewall during use.

32. The kiln of claim 29, further comprising a lifting device having a pulley actuated arm engaging the top of the primary firing chamber during use to and raise and lower the primary chamber along the longitudinal axis, the pulley actuating the arm rotating about an axis parallel to the longitudinal axis.

33. The kiln of claim 29, further comprising a pulley having a cable with a first end connected to a lift arm that is connected to the primary firing chamber to lift and lower the primary firing chamber, the pulley being rotatably mounted on a pole to rotate about a longitudinal axis of the pole parallel to the longitudinal axis of the kiln.

34. The kiln of claim 33, further comprising a first guide member extending parallel to the longitudinal axis of the kiln and connected to the primary firing chamber, and a guide post aligned with the longitudinal axis of the kiln during use and located to releasably engage the first guide member as the primary firing chamber moves along the longitudinal axis, the guide post having a length selected to allow the first guide member disengage from the guide post.

35. The kiln of claim 34, further comprising a counterweight connected to a second end of the cable.

36. The kiln of claim 34, wherein there is more than one burner and all burners fire into the sub-chamber.

* * * * *